US006312089B1

(12) United States Patent
Imai

(10) Patent No.: US 6,312,089 B1
(45) Date of Patent: Nov. 6, 2001

(54) INK JET RECORDER

(75) Inventor: Koji Imai, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/111,802

(22) Filed: Jul. 8, 1998

(30) Foreign Application Priority Data

Jul. 8, 1997 (JP) ..... 9-182745

(51) Int. Cl.[7] ..... B41J 2/165
(52) U.S. Cl. ..... 347/24; 347/29; 347/23
(58) Field of Search ..... 347/23, 29, 24, 347/35, 33

(56) References Cited

U.S. PATENT DOCUMENTS 5,182,582 * 1/1993 Okamura ..... 347/33
5,581,282 * 12/1996 Okamura ..... 347/33
5,726,692 * 3/1998 Yamaguchi et al. ..... 347/23

FOREIGN PATENT DOCUMENTS

A-9-85366 3/1997 (JP) .
A-9-85684 3/1997 (JP) .

* cited by examiner

*Primary Examiner*—N. Le
*Assistant Examiner*—Shih-wen Hsieh

(57) ABSTRACT

An ink jet recorder includes a recording head having a plurality of ejection surfaces each containing a nozzle for ejecting a different ink, a purging device for purging the nozzle of one ejection surface at a time within the plurality of ejection nozzles, and a controller for controlling the purging device in such a manner that a nozzle for ejecting a darker color ink is purged before a nozzle for ejecting a lighter color ink. The nozzle for the darker color can have longer waiting time than the nozzle for the lighter color ink and thereby the air bubbles remained in the nozzle can be absorbed into the darker color ink. Noticeable lack of darker color ink on the color printed medium can be avoided.

16 Claims, 9 Drawing Sheets

INK JET RECORDER

BACKGROUND OF THE INVENTION

1. Field of the Invention

The present invention relates to an ink jet recorder having a purging device for sucking ink from a ink jet head and a purging method therefor.

2. Description of Related Art

Ink jet printers are known generally as ink jet recorders for recording on recording media, such as sheets of paper, by ejecting ink onto them. FIG. 9 of the accompanying drawings shows part of a conventional ink jet printer, which includes a recording head unit P3 having a recording head P2. The head P2 has four ejection nozzles P4, each of which has ejection holes (not shown) opening in its front surface P5. The ejection nozzles eject different colored inks including black, yellow, cyan and magenta, respectively. Four ink cartridges P1 containing the respective colored inks are mounted replaceably on the head unit P3, and each connected to the corresponding nozzle P4. After each cartridge P1 is replaced with a new one, ink is supplied from the new cartridge to the head P2, and can be ejected from the associated nozzle P4.

The printer is provided with a purging device having a cap P6 and a suction pump (not shown) in order to purge the nozzles P4. The purging may be started manually by the user operating a switch on the printer, or automatically if a predetermined condition is satisfied. The purging is performed to prevent the defective ejection of ink which may be caused if the ink in or on the recording head P2 dries, or if air bubbles are produced in the ink, or if droplets of ink stick to the nozzle surfaces P5. The purging is also performed for introducing the ink into the recording head P2 when the ink cartridge P1 is replaced. Specifically, the purging of each nozzle P4 involves covering its nozzle surface P5 with a suction cap P6, and then developing negative pressure in the cap P6 by means of a suction pump (not shown), in order to suck ink from the head P2 through the cap P6 and discharge the sucked ink outside.

Conventionally, when the purging operation is performed for all four ejection nozzles P4, the four ejection nozzles P4 will be successively purged using one suction cap P6. The order in which the nozzles will be subjected to purging is determined by the lightness of the ink for the following reason. For example, when the purging operation is performed on two nozzles, the ink from one nozzle purged earlier may be deposited on the surface of the other nozzle to be purged next by the suction cap P6. In this situation, if the ink color ejected from the other nozzle is darker than that from the earlier purged nozzle, the printed color is little damaged because the darker color ink from the other nozzle might not be affected by the lighter color ink.

However, there has been a problem when the purging operation is performed in such a way that the ejection nozzle for the lighter color ink is purged earlier than the nozzle ejecting the darker ink. When the recording starts immediately after the purging, non-ejection of the darker ink might occur because of the air bubbles remaining in an ink passage after the purging. The non-ejection results in a noticeable lack of color on the printing medium. In order to avoid the problem, a certain waiting time was needed after the completion of purging before the recording could be started, so that the air bubbles in the passage could be absorbed into the ink, and thereby vanish therein.

U.S. patent application Ser. No. 09/053,756 filed on Apr. 2, 1998, which will be assigned to the present Assignee and corresponds to Japanese Patent Application No. 9-85366 filed on Apr. 3, 1997, discloses an ink jet printer provided with a recording head having a plurality of ejection surfaces each containing a nozzle for ejecting a different ink and a purging device for purging the nozzle of one ejection surface at a time. The printer also has a controller for controlling the purging device such that a nozzle having an ink with higher dry resistance is purged before a nozzle having an ink with lower dry resistance. The printer can prevent the nozzles from drying during the purging operation.

U.S. patent application Ser. No. 08/995,516 filed on Dec. 22, 1997, which will be assigned to the present Assignee and corresponds to Japanese Patent Application No. 9-85684 filed on Mar. 19, 1997, discloses an ink jet recorder provided with a plurality of recording heads each having ejection nozzle for ejecting a different color ink, an ink suction device for sucking ink from each head, and a pre-ejecting device for ejecting ink toward a portion for receiving used ink after sucking ink. When the ink is sucked from at least two heads within the plurality of heads, the ink suction device sucks the ink in an order which is different from an order of lightness of the ink color. As the ink for pre-ejection has a lighter color, the pre-ejection device pre-ejects the ink in larger amount.

SUMMARY OF THE INVENTION

It is an object of the invention, made in consideration of the aforementioned problem, to provide an ink jet recorder which can perform good color recording without noticeable lack of color even when the recording starts immediately after the purging operation. It is another object of the invention to provide a method for purging nozzles of the ink jet recorder, which can result in good color recording without noticeable lack of color even when the recording starts immediately after the purging operation.

According to a first aspect the invention, an ink jet recorder comprising: a recording head having a plurality of ejection surfaces each containing a nozzle for ejecting a different ink; a purging device that purges the nozzle of one ejection surface at a time within the plurality of ejection nozzles; and a controller that controls the purging device in such a manner that a nozzle for ejecting a darker color ink is purged before a nozzle for ejecting a lighter color ink.

As described above, if the lack of color occurs during ink jet recording due to defective recording, the lack of darker color ink on the color printed medium becomes more noticeable than the lighter color ink. However, the inventive ink jet recorder performs the purging operation such that the nozzle for the darker color ink is purged before the nozzle for the lighter color ink. In other words, the ejection nozzle for the darker color can have a longer waiting time than the nozzle for the lighter color ink until the recording is started after completion of the purging for all the nozzles. During this waiting time, the air bubbles remaining in the nozzle or the ink passage can be absorbed into the darker color ink and vanish. Thus, the lack of the darker color ink can be eliminated. Although the defective ejection of the nozzle might occur in the nozzle for the lighter color ink, the lack of color will be less noticeable due to the lightness of the color.

The purging device may comprise a suction cap to cover the one ejection surface and a suction pump to suck an ink in the recording head through the suction cap and the nozzle. The recorder may further comprise a moving device for moving the suction cap relative to the nozzle. The ink jet recorder may also comprise a carriage for holding the recording head thereon and moving relative to the purging device. The controller may control a position of the carriage relative to the purging device so that the nozzle for ejecting the darker color ink is purged before the nozzle for ejecting the lighter color ink.

The ink jet recorder may further comprise a wiper for wiping an ink deposited on the ejection surface. The controller may control the wiper so as to wipe the ink deposited on the ejection surface after the purging of each ejection surface. By using the wiper, ejection characteristics can be maintained as they were designed to be, and thus excellent color recording can be ensured.

The ink jet recorder may further comprise an ink receiver for receiving an ink flashed by the recording head. In this case, the controller may control the recording head so as to flash by means of ejecting the ink from the ejection nozzle toward the ink receiver. This flashing can prevent the darker color ink from mixing, through purging, into the lighter color ink in the ejection nozzle thereof. The plurality of ejection surfaces may be for ejecting magenta, cyan, yellow and black inks, respectively. In this situation, a nozzle for ejecting the black ink is purged first based on the present invention. The ink jet recorder may further comprise a memory, such as a ROM, for storing information on an order of nozzles being purged.

According to a second aspect of the invention, a purging method for an ink jet recorder comprising a recording head having a plurality nozzles for ejecting a plurality of colored inks and a purging device capable of purging one of the nozzles at a time, characterized in that a nozzle for ejecting a darker color ink is purged before a nozzle for ejecting a lighter color ink. The purging method may further comprising the steps of wiping the ejection surface which has been purged and/or flashing the recording head after purging prior to recording.

When an ink cartridge is replaced with a new one as described above, air tends to enter into the recording head and causes defective ejection or non-ejection. In order to avoid the defective ejection, it is advantageous to apply the inventive purging method immediately after the replacement of the ink cartridge.

BRIEF DESCRIPTION OF THE DRAWINGS

Preferred embodiments of the invention are shown in the accompanying drawings, in which.

DETAILED DESCRIPTION OF A PREFERRED EMBODIMENT

Figure 1:
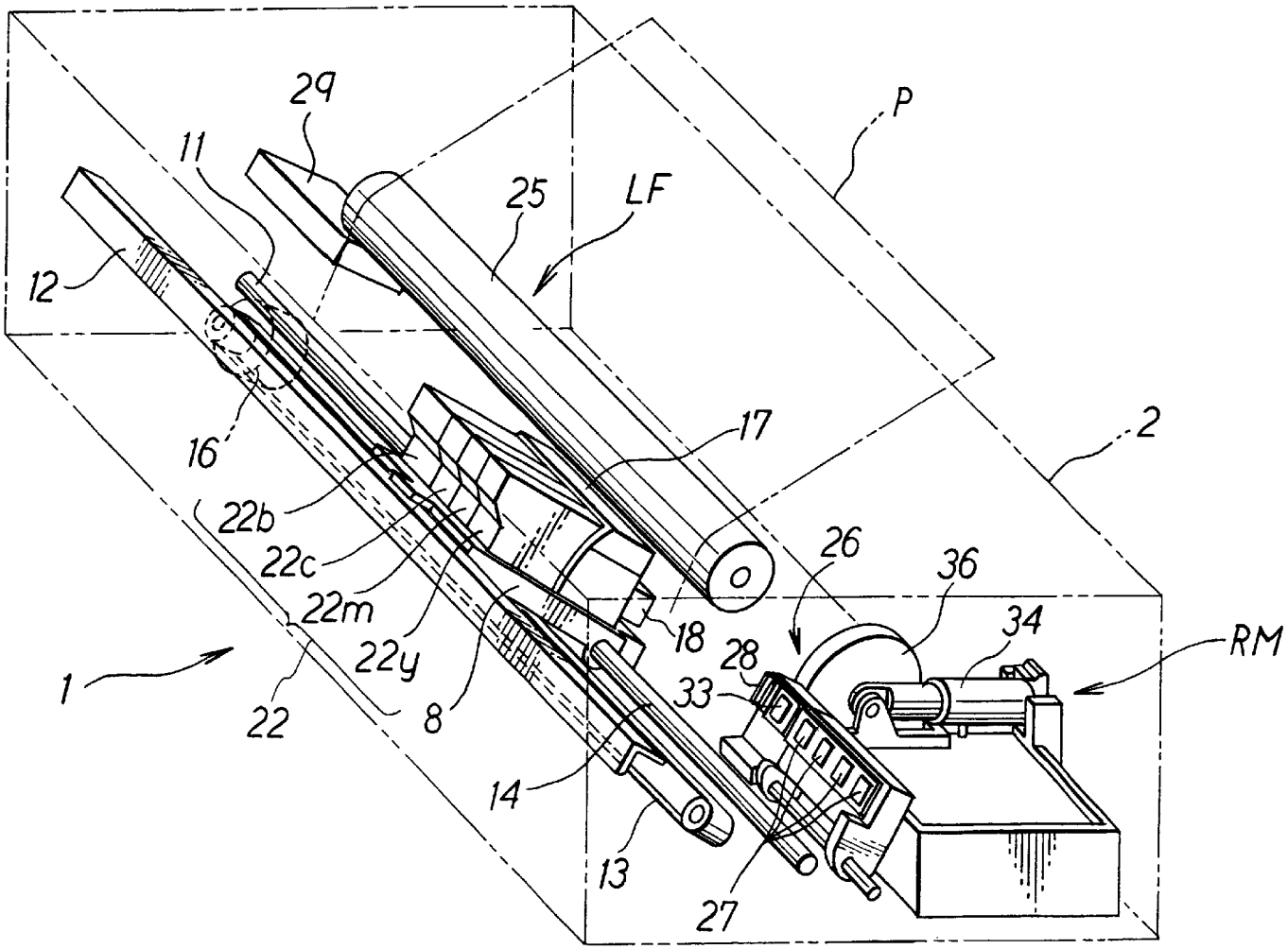
FIG. 1 is a perspective view of the internal structure of an ink jet printer according to the invention.

FIG. 1 shows the internal structure of an ink jet printer 1 according to an embodiment of the invention. The printer 1 includes a frame 2. A guide rod 11 and a guide member 12 extend horizontally in parallel, and are fixed to the frame 2. A carriage 8 is supported slidably on the rod 11 and member 12, and is fixed to a timing belt 13, which can be driven by a carriage drive motor (CR motor) 16 in order for the carriage 8 to reciprocate along the rod 11 and member 12. Mounted on the carriage 8 is an ink jet type recording head unit 17, which includes a recording head 18 for printing a recording sheet or medium P by ejecting droplets of ink of four colors onto the sheet. The four colors are cyan c, magenta m, yellow y and black b (henceforth, the ink color of cyan, magenta, yellow and black are referred as letters "c", "m", "y" and "b", respectively).

Figure 2:
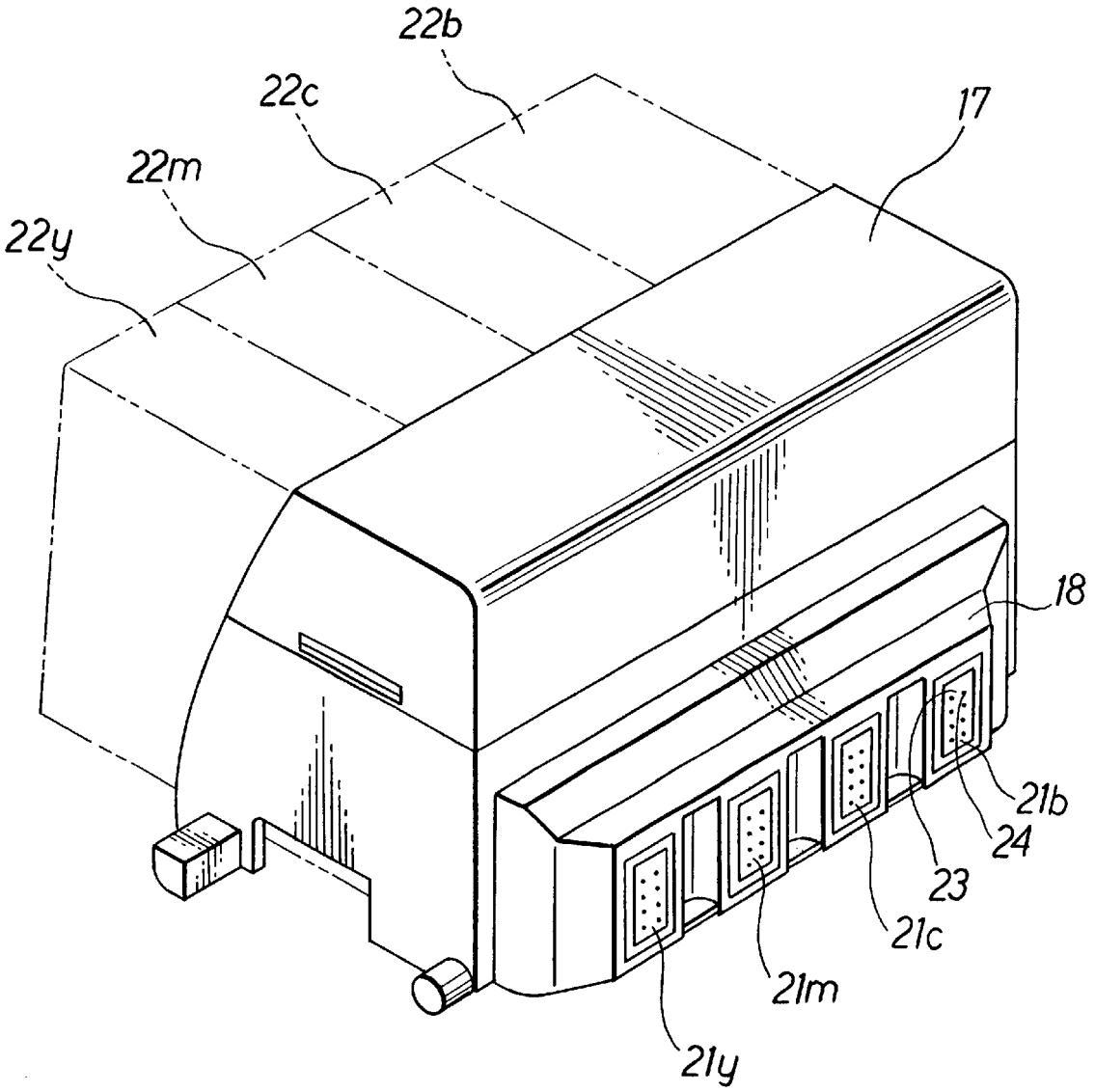
FIG. 2 is an enlarged perspective view of the recording head unit of the printer according to the invention.

As shown in FIG. 2, the recording head 18 has ejection nozzles 21 (21*y*, 21*m*, 21*c*, 21*b*). Mounted removably on the back side of the head unit 17 are ink cartridges 22 (22*y*, 22*m*, 22*c*, 22*b*) for supplying the nozzles 21*y*, 21*m*, 21*c* and 21*b*, respectively, with inks. Each nozzle 21 has a nozzle surface (ejection surface) 23, where a number of ejection holes 24 open. The holes 24 may be 64 in number.

Returning to FIG. 1, the recording head 18 faces a feed mechanism LF for feeding a recording sheet P. The mechanism LF includes a platen roller 25 extending in parallel to the guide rod 11 and member 12. The roller 25 is supported by the frame 2, and can be rotated by a feed motor (LF motor) 30 (FIG. 5) to feed a recording sheet P.

Positioned on one side of the feed mechanism LF is a maintenance/recovery mechanism RM for maintaining and recovering ejection of ink from the recording head 18. This mechanism RM includes a suction device (purging device) 26 for eliminating the defective ejection of ink occurred in various conditions. The mechanism RM also includes preservation caps 27 each for covering one of the nozzle surfaces (ejection surfaces) 23 to prevent it from drying while the printer 1 is not used. The mechanism RM further includes a wiper 28 for wiping the nozzle surfaces 23.

Figure 3:
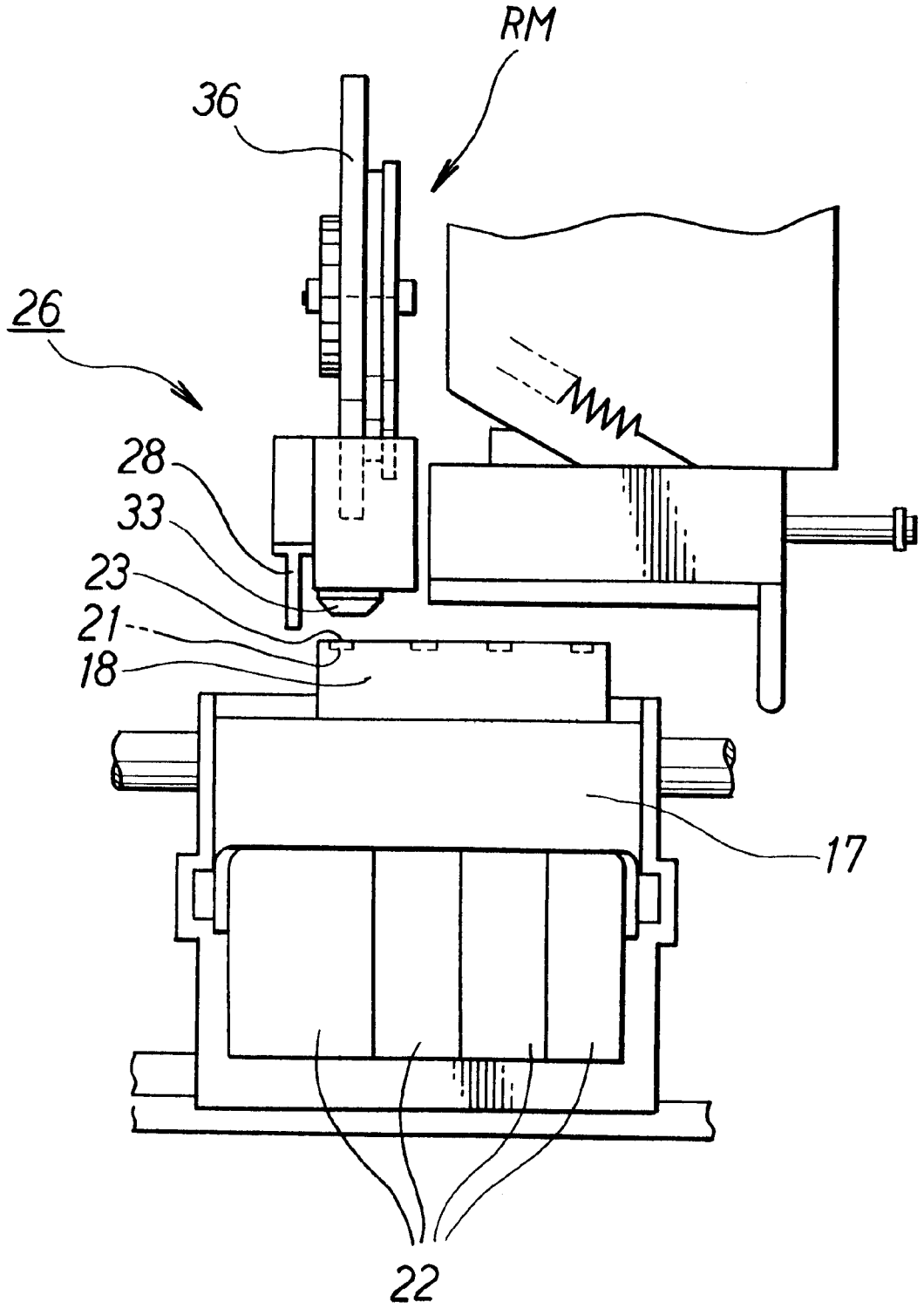
FIG. 3 is a perspective view showing structure of a maintenance/recovery mechanism of the printer shown in FIG. 1.

As shown in FIGS. 1 and 3, the suction device 26 includes a suction cap 33 which can move into and out of close contact with nozzle surface 23 of each ejection nozzle 21 of the recording head 18. The device 26 also includes a suction pump 34 (FIG. 1) for sucking ink through the cap 33 from the head 18 while this cap is in close contact with the head.

Figure 5:
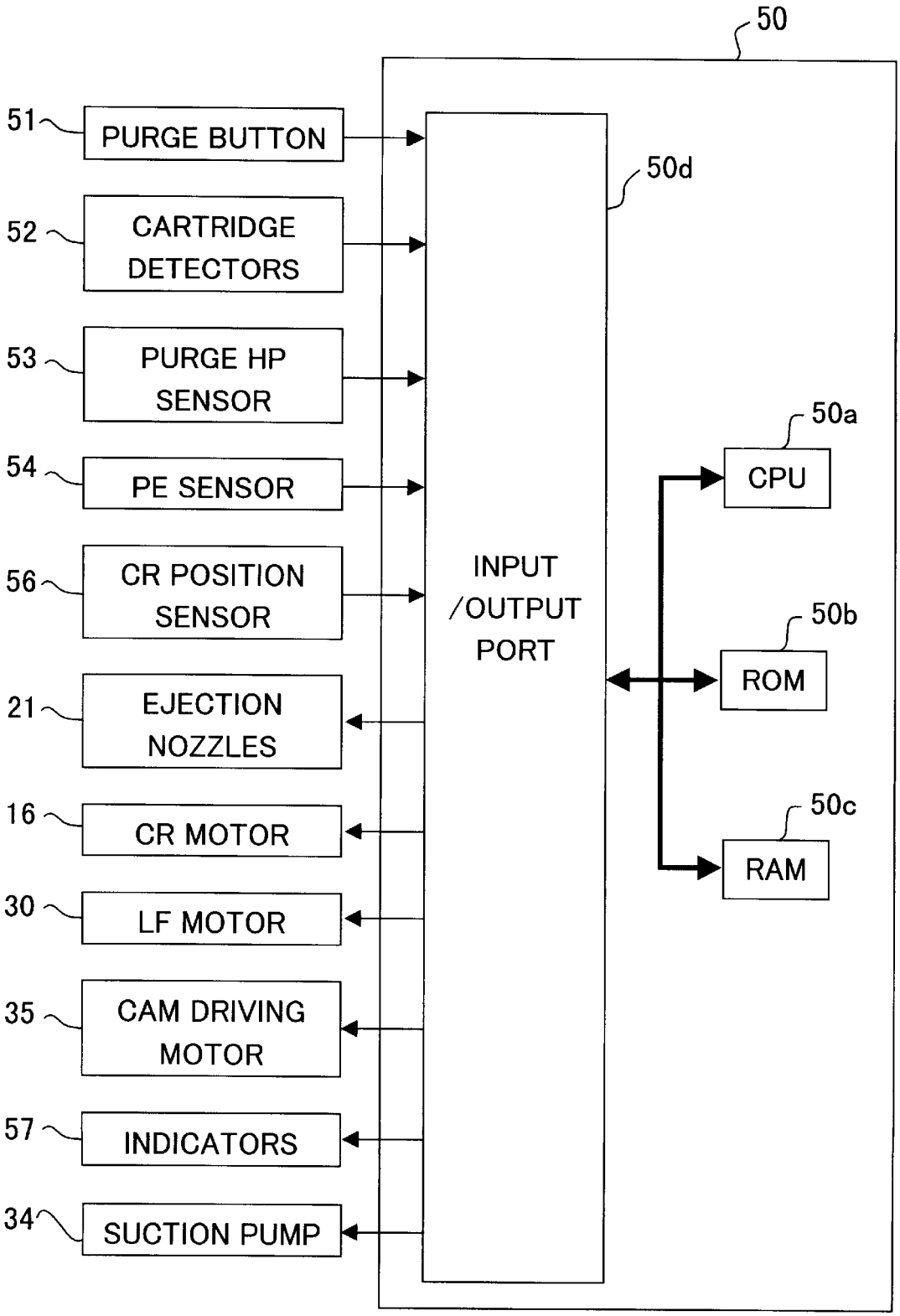
FIG. 5 is block diagram of the electric structure or construction of the printer according to an embodiment of the invention.

The maintenance/recovery mechanism RM also includes a cam 36 which can be driven by a cam drive motor 35 (FIG. 5). The cam 36 can move the suction cap 33 and the wiper 28 forward toward the recording head 18 and backward, and drive the pump 34 to purge the head through the suction cap.

Figure 4:
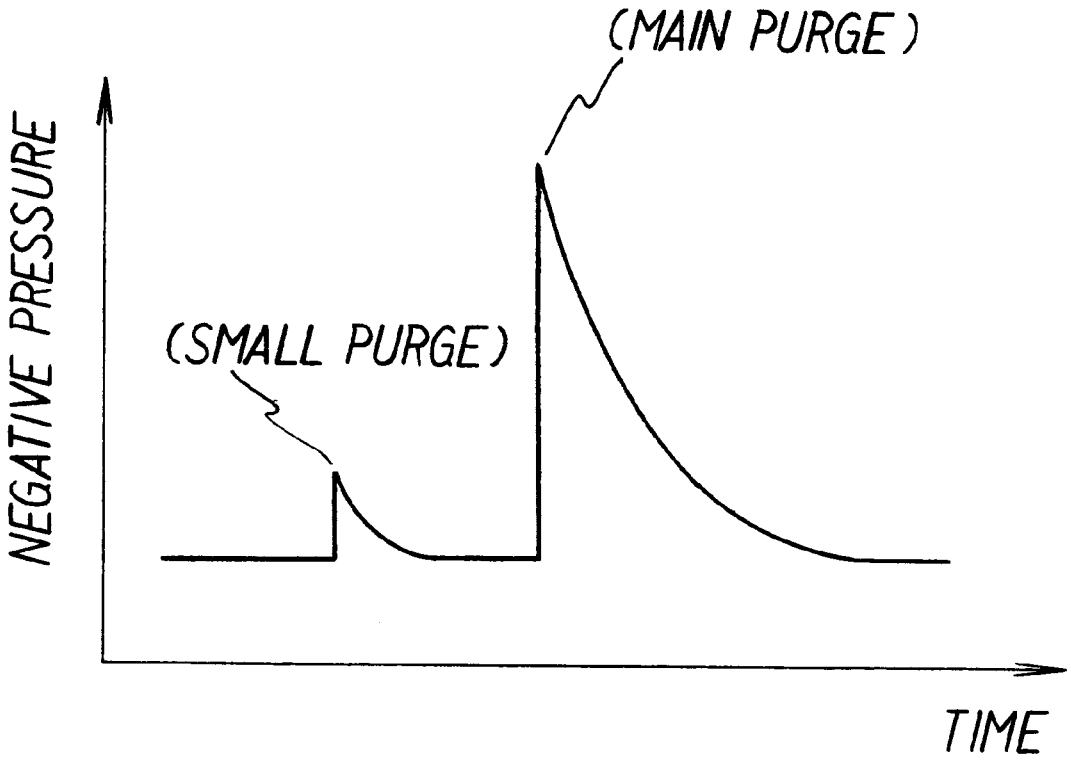
FIG. 4 is a graph showing the change in the negative pressure developed by the suction pump of the printer while the recording head of the printer is purged.

Specifically, while the pump 34 is reciprocating once, a cycle of suction is performed as shown in FIG. 4. The cycle includes a small purge with a low negative pressure and a main purge with a higher negative pressure. The small purge is followed by the main purge. Each ejection nozzle 21 may be purged normally by three cycles of the purges.

Further, the suction device 26 can suck and remove a preserved liquid in the recording head 18 at a time the ink cartridge 22 is initially loaded, or guide the ink in the cartridge 22 into the recording head 18 at a time the cartridge 22 is exchanged.

A wiper 28 is provided at the side of the suction cap 33 as shown in FIG. 3. The wiper 28 wipes away the ink remained on the nozzle surface 23 of the ejection nozzle 21.

A receiver 29 is also provided at the opposite side to the maintenance/recovery mechanism RM with respect to the feed mechanism LF. The receiver 29 is made of porous material to receive or absorb the waste ink. By ejecting the ink from the ejection nozzle 21 toward the receiver 29, flashing is done. The flashing causes the air bubbles and the turbid ink in the recording head 18 and the ejection nozzle 21 to discharge.

FIG. 5 shows the electric structure of the printer 1. The printer 1 includes a control unit (ECU) 50, which is a well known microcomputer including a CPU 50*a*, a ROM 50*b*, a RAM 50*c* and an input/output port 50*d*. The control 50 controls the operation of the printer 1 in a manner for known printers.

The input/output port 50*d* is connected to a purge button 51 and other switches, cartridge detectors 52, a purge HP sensor 53, a PE sensor 54, a CR position sensor 56, etc. The purge button 51 can be pushed to instruct the control 50 to perform the purging operation. Each cartridge detector 52 can detect an ink cartridge 22 being present on and absent from the head unit 17, The purge HP sensor 53 can sense the suction cap 33 being at its home position. The PE sensor 54 can sense the front end of a recording sheet P being fed. The CR position sensor 56 can sense the position of the carriage 8.

Figure 6:
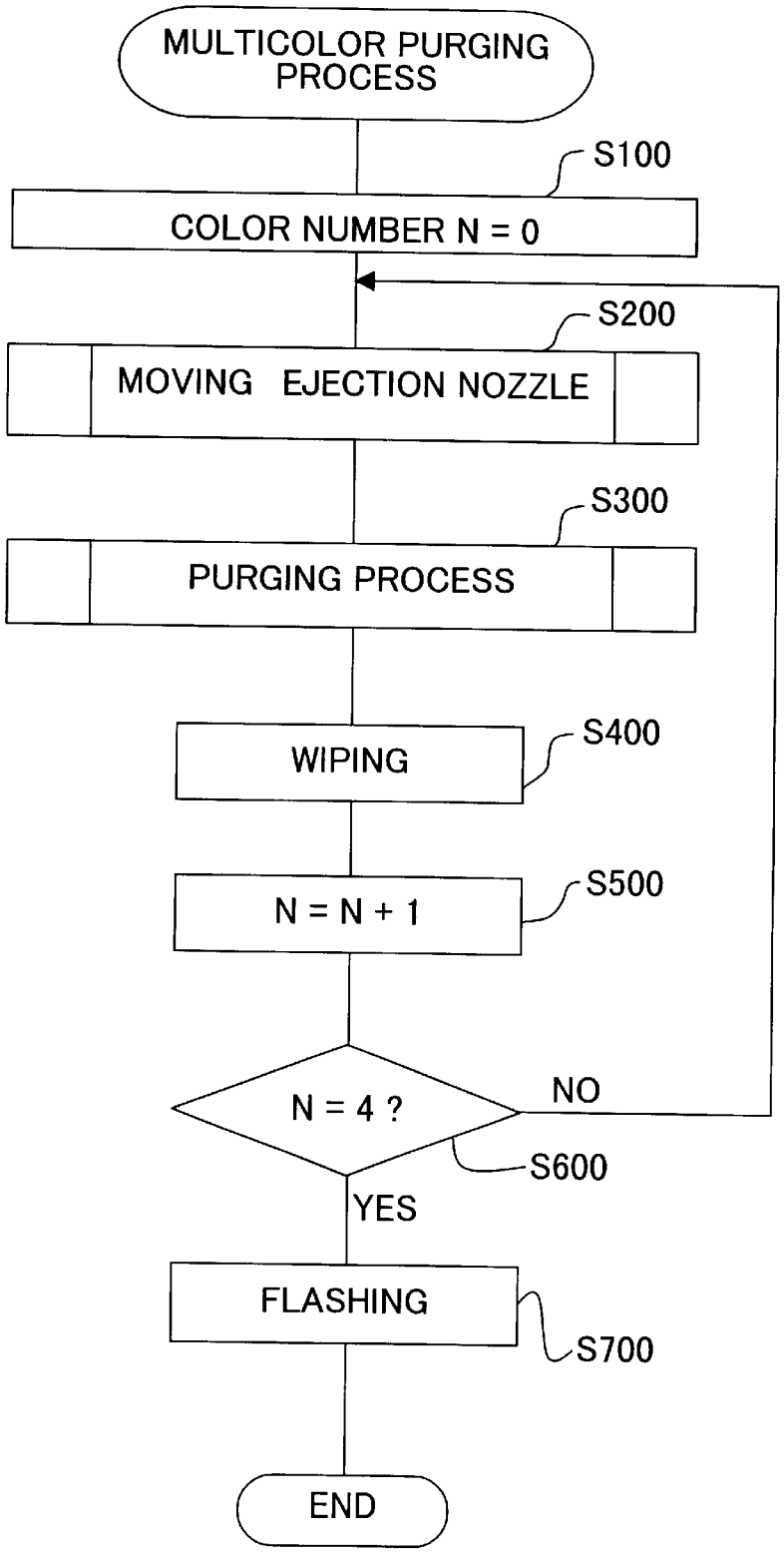
FIG. 6 is a flowchart of a process for multicolor purging operation according to the embodiment of the invention.
Figure 7:
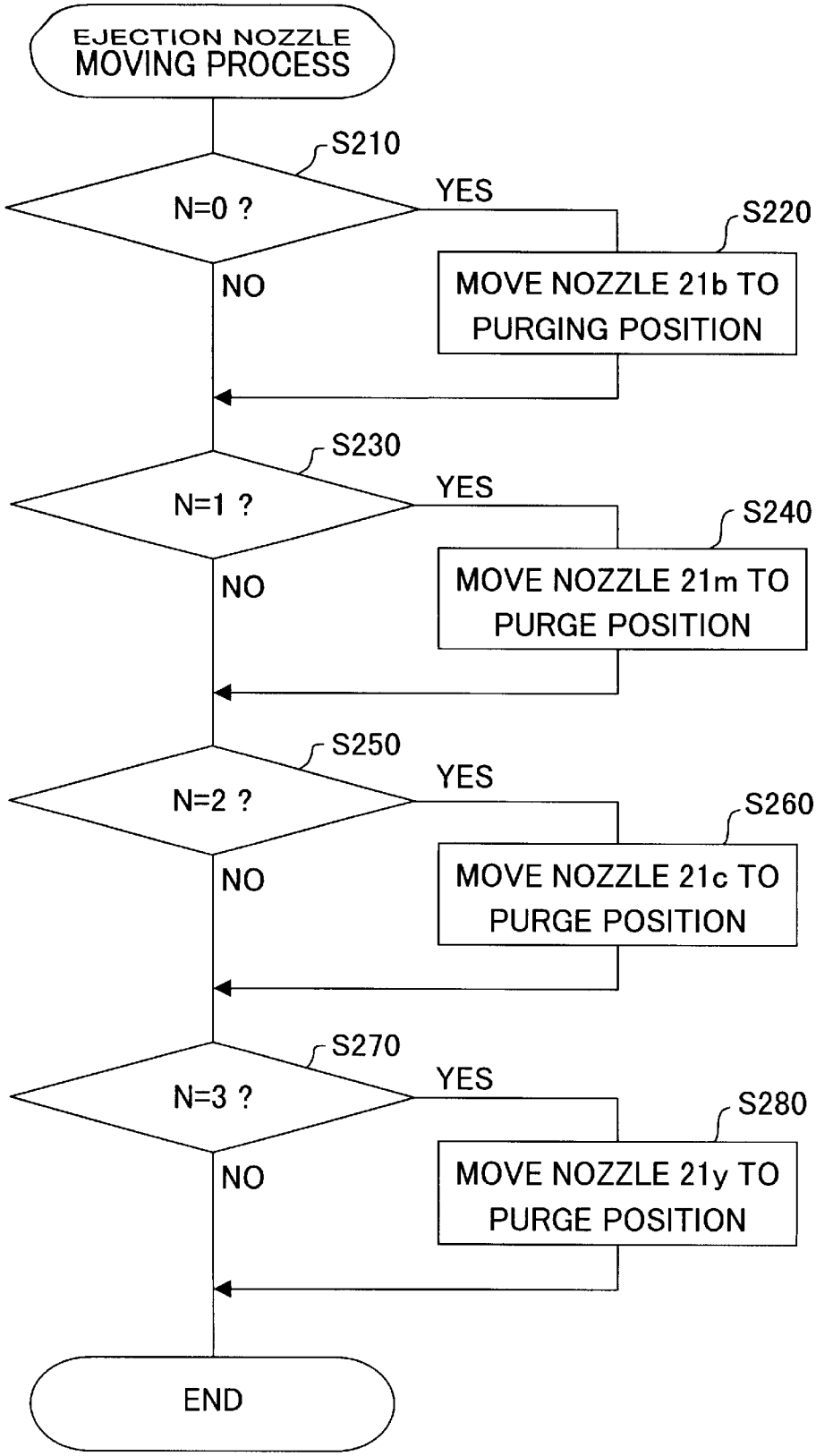
FIG. 7 is a flowchart of ejection nozzles moving process according to the embodiment of the invention.

The input/output port 50*d* is also connected to the nozzles 21, which are actuators for ejecting ink, the CR motor 16, the LF motor 30, the cam drive motor 35 for driving the cam 36, which can drive the suction device 26, and indicators 57 for indicating the present operating conditions etc. FIGS. 6 and 7 show a process of controlling the printer 1.

A multicolor purging process shown in FIG. 6 is performed by the control 50 when certain conditions are met, that is, when the purge button 51 is pushed to direct the purging operation, and the cartridge detector 52 detects that the cartridge 22 is detached and reattached. After this process starts, the color number N is set first at 0 (S100).

Then, ejection nozzle moving step is performed (S200) by moving one nozzle of the ejection nozzles 21 (21*y*, 21*m*, 21*c*, 21*b*) to a position where the nozzle can face the suction cap 33 (henceforth, the position is referred as the purge position). Specifically, the nozzle is appropriately moved to the purge position by driving the CR motor 16 while the CR position sensor 56 is detecting the position of the carriage 8.

FIG. 7 shows the nozzle moving step (S200). As shown in FIG. 7, first, it is judged as to whether the color number N is 0 or not (S210). If N is 0, the nozzle 21*b* for black ink is moved to the purge position (S220). Next, it is judged if the color number N is 1 or not (S230) regardless of the result of the step 210. If N is 1, the nozzle 21*m* for magenta ink is moved to the purge position (S240). Next, it is judged if the color number N is 2 or not (S250) regardless of the result of the step 230. If N is 2, the nozzle 21*c* for cyan ink is moved to the purge position (S260). Last, it is judged if the color number N is 3 or not (S270) regardless of the result of the step 250. If N is 3, the nozzle 21*y* for yellow ink is moved to the purge position (S280).

Figure 8:
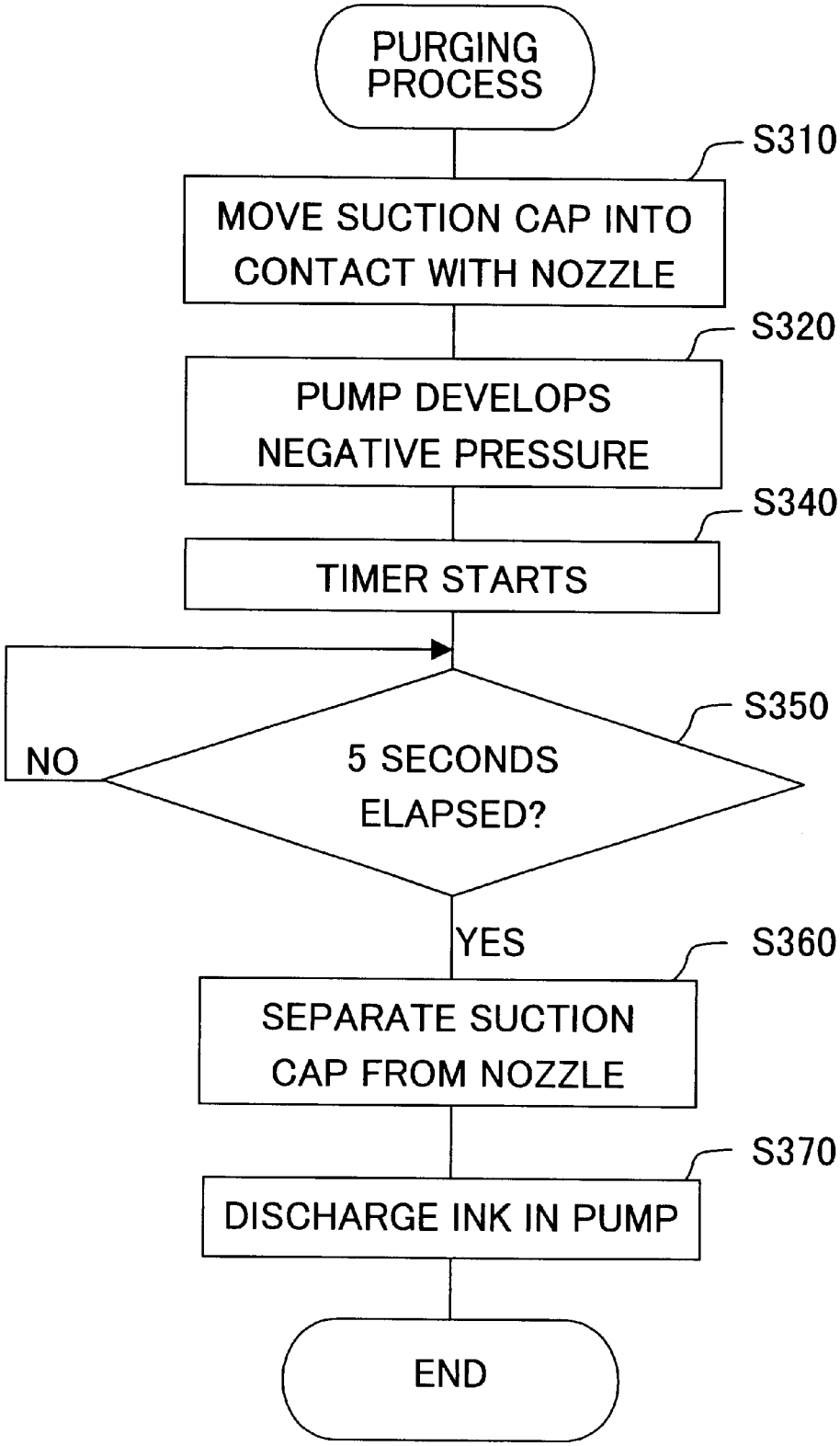
FIG. 8 is a flowchart of a process for purging operation according to the embodiment of the invention.
Figure 9:
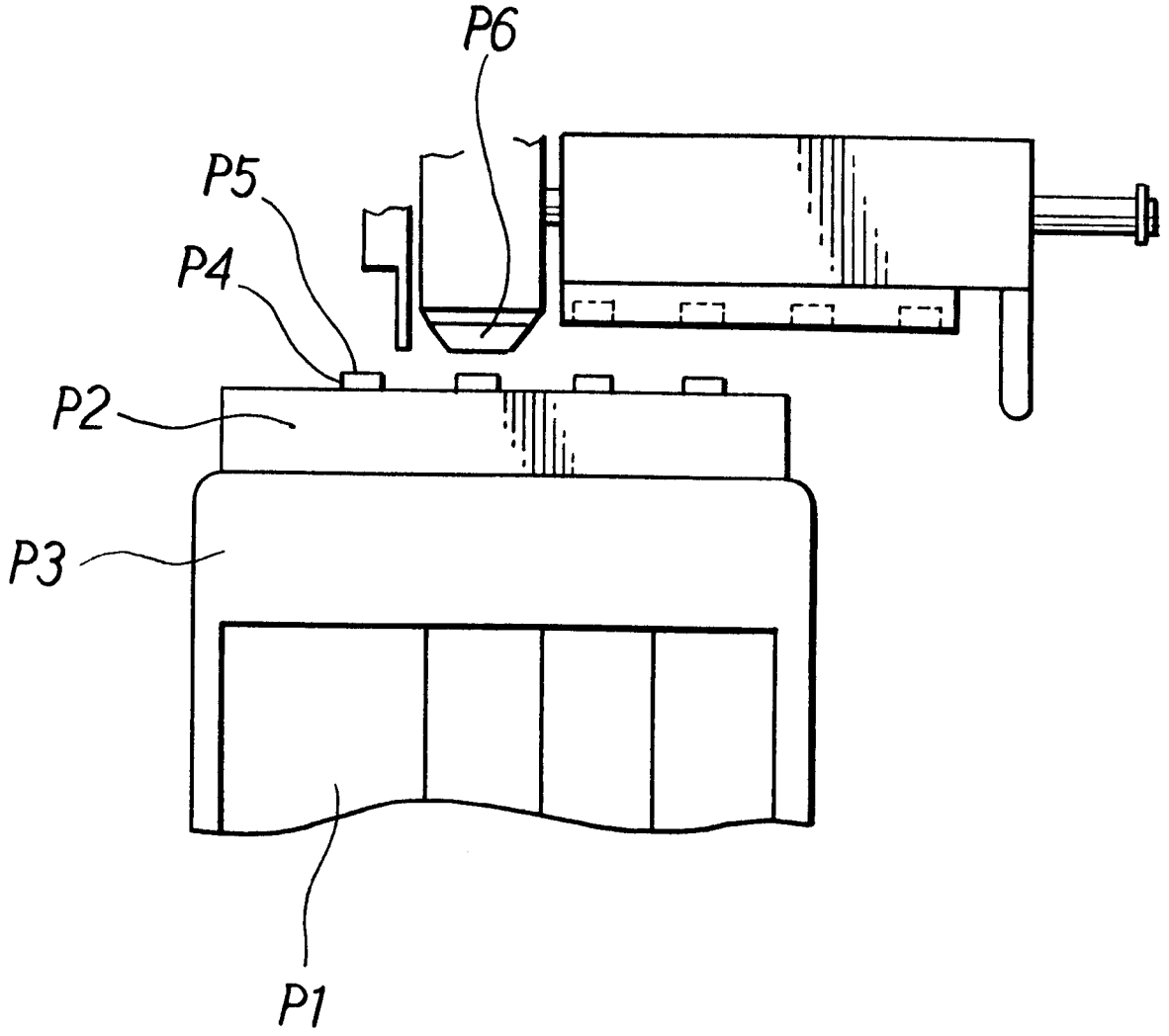
Fig. 9 PRIOR ART
FIG. 9 is an explanatory view of a conventional ink jet printer showing mechanism of suctioning inks.

After one of the nozzles 21 ink thus moved to the predetermined position (S200), it is purged there (S300). However, it can be understood that the nozzle 21*b* for ejecting black ink is purged first according to the step S100 of FIG. 6. As shown in FIG. 8, the purge process (S300) includes moving the suction cap 33 into contact with the nozzle surface 23 of the nozzle 21 (S310), and driving the pump 34 to develop negative pressure (S320). At this stage, the cap 33 communicates with the pump 34, and therefore the negative pressure is applied to the interior of the nozzle 21. Then, a timer is started clocking or timing the suction of ink from the nozzle 21 (S340). The suction is continued for a predetermined period, which may be five seconds (if it is less than five seconds, S350: no). While ink is sucked from the nozzle 21, the sucked ink is collected once in the pump 34. When the period (5 seconds) has elapsed (S350: yes), the cap 33 is separated from the nozzle 23 (S360). Thereafter, the ink in the pump 34 is discharged (S370).

After the purging (S300) ends, the carriage 8 is moved in order for the wiper 28 to wipe away the ink on the nozzle surface 23 of the just purged nozzle 21 (S400). Then, 1 is added to the color number N (S500), and it is judged if N is 4 or not, namely, the purging operation is performed for all ejection nozzles (S600).

If the color number is not 4, steps S200–S500 are performed, and if the color number is 4, the carriage 8 is moved to position all the nozzles 21 in front of an ink receiver 29. In this position, the nozzles 21 perform ejection in order to be flushed so that the air bubbles etc. are removed completely out of the nozzles 21 (S700). Then, the multicolor process ends.

Thus, when the plurality of ejection nozzles 21 are purged, the purging is performed on the basis of the color number N. Specifically, the purging is performed for the ejection nozzles 21*b*, 21*m*, 21*c* and 21*y* in the order, which correspond to ink colors black b, magenta m, cyan c and yellow y respectively. Therefore, the purging period for the nozzle ejecting the lighter color ink like the nozzle 21*y* can be used as a standby time for the nozzle ejecting the darker color ink like the nozzle 21*b*. Accordingly, the air bubbles remained after purging can be absorbed in the ink to vanish during the standby time. Thereby, the possibility of the defective ejection, such as the non-ejection can be decreased. On the other hand, the defective ejection of the nozzle might occur in the nozzle ejecting lighter color ink. However, even though the lack of color exists on the printed paper, it is less noticeable defects due to the lightness of the color, so that the whole color image can not be damaged.

In the embodiment, the purging controller controls steps S200 and S300. In these steps, the purging of the nozzles 21 are performed in order of the darker color inks on the basis of the color number N to which 1 is added according to the flowchart in FIG.6.

The invention is not limited to embodiments described above and may be performed in various specific forms without departing from the sprit of the invention. For example, the order of the purging can be changed. As mentioned in the embodiment, the purging for the nozzles is performed in the order of nozzles 21*b*, 21*m*, 21*c* and 21*y* which correspond to black, magenta, cyan and yellow, respectively. However, the order of the purging for the nozzles 21*m* and 21*c* may be reversed. Further, when a plurality of nozzles eject inks which have the same color (hue) but different brightness, one nozzle for darker ink may be purged earlier than another nozzle. In the ink jet recorder, the nozzle (ejection) surfaces may arranged so as to be lined up from one end of the recording head according to the darkness of inks ejected from the ejection surfaces. In this arrangement, movement of the recording head or the carriage relative to the purging device can be minimized and the purging operation time can be shortened.

The embodiment has been explained for the ink jet printer, but the invention may be applied to any types of recorders such as a facsimile machine.

What is claimed is:

1. An ink jet recorder comprising:

a recording head having a plurality of ejection surfaces each containing a nozzle for ejecting a different ink;

a purging device provided with a suction cap for covering one ejection surface of the ejection surfaces and a suction pump for sucking an ink in the nozzle of the one ejection surface through the suction cap in order to purge the nozzle; and a controller that controls the purging device in such a manner that a nozzle for ejecting a darker color ink is purged before a nozzle for ejecting a lighter color ink.

2. The ink jet recorder according to claim 1, wherein the recorder further comprises a moving device for moving the suction cap relative to the nozzle.

3. The ink jet recorder according to claim 1, further comprising a carriage that holds the recording head thereon and is movable relative to the purging device.

4. The ink jet recorder according to claim 3, wherein the controller controls a position of the carriage relative to the purging device so that the nozzle for ejecting the darker color ink is purged before the nozzle for ejecting the lighter color ink.

5. The ink jet recorder according to claim 1, further comprising a wiper for wiping an ink deposited on the ejection surface.

6. The ink jet recorder according to claim 5, wherein the controller controls the wiper so as to wipe the ink deposited on the ejection surface after the ejection surface is purged by the purging device.

7. The ink jet recorder according to claim 1, further comprising an ink receiver that receives ink flashed by the recording head.

8. The ink jet recorder according to claim 7, wherein the controller controls the recording head so as to flash by ejecting the ink from the ejection nozzle toward the ink receiver.

9. The ink jet recorder according to claim 1, wherein the plurality of ejection surfaces are for ejecting magenta, cyan, yellow and black inks, respectively.

10. The ink jet recorder according to claim 9, wherein a nozzle ejecting the black ink is purged first.

11. The ink jet recorder according to claim 1, further comprising a memory storing information on an order in which nozzles are purged.

12. The ink jet recorder according to claim 1, wherein the surfaces are arranged so as to be lined up from one end of the recording head according to the darkness of inks ejected from the ejection surfaces.

13. The ink jet recorder according to claim 1, which is an ink jet printer.

14. A purging method for an ink jet recorder comprising a recording head having a plurality nozzles for ejecting a plurality of colored inks and a purging device capable of purging one of the nozzles at a time, wherein the purging device is provided with a suction cap for covering one nozzle and a suction pump for sucking an ink in the nozzle through the suction cap in order to purge the nozzle, and characterized in that a nozzle for ejecting a darker color ink is purged before a nozzle for ejecting a lighter color ink.

15. The purging method according to claim 14, further comprising wiping the ejection surface which has been purged.

16. The purging method according to claim 14, further comprising flashing the recording head after purging prior to recording.

* * * * *